US008540075B2

(12) United States Patent
Chau

(10) Patent No.: US 8,540,075 B2
(45) Date of Patent: Sep. 24, 2013

(54) SQUARE CIGAR TUBE

(75) Inventor: Ngan Andrew Chau, Guangdong (CN)

(73) Assignee: Almaster Research & Development Co., Ltd., Guangdong (CN)

( * ) Notice: Subject to any disclaimer, the term of this patent is extended or adjusted under 35 U.S.C. 154(b) by 0 days.

(21) Appl. No.: 13/575,025

(22) PCT Filed: Sep. 16, 2011

(86) PCT No.: PCT/CN2011/079730
§ 371 (c)(1), (2), (4) Date: Jul. 24, 2012

(87) PCT Pub. No.: WO2012/055305
PCT Pub. Date: May 3, 2012

(65) Prior Publication Data

US 2012/0292207 A1 Nov. 22, 2012

(30) Foreign Application Priority Data

Oct. 29, 2010 (CN) ..... 2010 2 0594582 U

(51) Int. Cl.
*B65D 85/12* (2006.01)

(52) U.S. Cl.
USPC ..... 206/259; 206/242; 206/818

(58) Field of Classification Search
USPC ..... 206/238, 242, 259, 265, 267, 270, 206/818; 131/250; 220/8
See application file for complete search history.

(56) References Cited

U.S. PATENT DOCUMENTS

| | | | | |
|---|---|---|---|---|
| 163,395 | A * | 5/1875 | Norton | 206/242 |
| 2,125,620 | A * | 8/1938 | Schlumbohm | 206/242 |
| 6,290,059 | B1 * | 9/2001 | Chuan | 206/238 |
| 6,831,541 | B1 * | 12/2004 | Seidler | 335/306 |
| 2002/0144915 | A1 * | 10/2002 | Atkinson et al. | 206/278 |
| 2011/0067713 | A1 * | 3/2011 | Egued | 131/250 |

* cited by examiner

*Primary Examiner* — David Fidei

(57) ABSTRACT

Disclosed is a square cigar tube, comprising a first square tube part (1) and a second square tube part (2). The first square tube part and the second square tube part are connected; a through hole (11) is arranged in the first square tube part, and a through hole (21) is arranged in the second square tube part; a first magnet accommodating space (12) is arranged on an end surface of the first square tube part connected to the second square tube part, and a first tube lid (3) is arranged on the other end; a second magnet accommodating space (22) is arranged on an end surface of the second square tube part connected to the first square tube part, and a second tube lid (4) is arranged on the other end; a first magnet (8) is arranged in the first accommodating space, and a second magnet (9) is arranged in the second accommodating space. The square cigar tube makes it easy to take out or put in a cigar, is accurate in positioning, and is convenient to clean.

6 Claims, 7 Drawing Sheets

SQUARE CIGAR TUBE

BACKGROUND OF THE INVENTION

The present invention relates to tubes for placing cigarettes and, more particularly, to a square tube for placing a cigar.

Present cigar tube is round in shape, which has a structure that includes a first round tube part and a second round tube part. The connection of the first round tube part and the second round tube part is realized by connecting, that is, the outer circle of the end of the first round tube part which connects with the second round tube part has a step, and the inside circle of the end of the second round tube part which connects with the first round tube part has a step hole. When connecting, the step is inserted into the step hole, and when manufacturing, if the machining precision is not high enough, there will appears an interference fit or a clearance fit between the step hole and the step. If it is interference fit, it is difficult to realize inserting in and pulling out, thus it is not easy to take out or put in a cigar, and if it is clearance fit, although it is easy to insert in and pull out, it will produce sway between the first round tube part and the second round tube part, thereby bringing inaccurate location. In addition, the tube lid and tube body of the first round tube part and second round tube part are integrated form which can not be disassembled, thus, it is very discommodious to clear the interior of the first round tube part and the second round tube part.

BRIEF SUMMARY OF THE INVENTION

An objective of the present invention is to provide a square cigar tube which is easy to take out or put in a cigar, is accurate in positioning, and is convenient to clean.

To achieve above-mentioned objective, the present invention provides a square cigar tube, which includes a first square tube part and a second square tube part; the first square tube part and the second square tube part are connected; a through hole is arranged in the first square tube part, and a through hole is arranged in the second square tube part; a first magnet accommodating space is arranged on an end surface of the first square tube part connected to the second square tube part, and a first tube lid is arranged on the other end; a second magnet accommodating space is arranged on an end surface of the second square tube part connected to the first square tube part, and a second tube lid is arranged on the other end; a first magnet is arranged in the first accommodating space, and a second magnet is arranged in the second accommodating space.

Owing to setting a first magnet accommodating space in an end of the first square tube part and then setting a first magnet in the first magnet accommodating space, setting a second magnet accommodating space in one end of the second square tube part and then setting a second magnet in the second magnet accommodating space, connection between the first square tube part and second square tube part can be realized by attracting between the first magnet and second magnet thereby easy to take out or put in a cigar. Because both of the cross-section contour of the first square tube part and that of the second square tube part are designed to be square, it is accurate in positioning. The first square tube part has a first tube lid mounted on one end thereof, the second square tube part has a second tube lid mounted on one end thereof, when cleaning, the first tube lid and second tube lid can be disassembled and a through hole is produced inside the first square tube part and second square tube part after disassembling, thus it is convenient to clean.

As an improvement, a first step round hole whose diameter is bigger than that of the through hole of the first square tube part is arranged in the through hole of the first square tube part and at the end close to the second square tube part; a second step round hole whose diameter is bigger than that of the through hole of the second square tube part is arranged in the through hole of the second square tube part at the end close to the first square tube part; a cigar aluminum tube is arranged both in the first step round hole and the second step round hole; a clearance is arranged between a step of the second step round hole and an end face of the cigar aluminum tube which is located in the second step round hole; a cedar or a fragrance fir is arranged in the clearance.

Owing to the cigar aluminum tube, which has one end extending into the first square tube part and the other end extending into the second square tube part, the first square tube part and second square tube part can be connected with each other firmly, and then the inner of the first and second square tube has good sealing performance. Due to setting a cedar or a fragrance fir in the clearance, the best taste and original humidity of the cigar can be kept by the cedar or fragrance fir.

As an improvement, a first step square hole whose side length is bigger than the diameter of the first step round hole is arranged in the first step round hole of the first square tube part at the end close to the second square tube part, a third tube lid is arranged in the first step square hole, and a through hole is formed on the third tube lid.

Due to the first step square hole, the positioning precision for mounting the third tube lid is very high; and the third tube lid is arranged to further improve the sealing performance of the first square tube part and second square tube part.

As an improvement, a fourth tube lid is arranged between the first square tube part and the second square tube part, the fourth tube lid is square and has a same section size as that of the second square tube part; a third magnet accommodating space is arranged on an end face of the fourth tube lid and the third magnet accommodating space is used for placing the second magnet.

The fourth tube lid is arranged for protecting the connecting faces of the first square tube part and second square tube part.

As an improvement, the first tube lid is cambered; a third step round hole is arranged on an end of the first square tube part for mounting the first tube lid, the first tube lid is arranged in the third step round hole.

The tube lid is designed to be round cambered for beautifying the appearance of the square cigar tube. The third step round hole is arranged for mounting the first tube lid conveniently and improving sealing performance of the inner of the first square tube part and second square tube part.

As an improvement, a second step square hole is arranged on an end of the second square tube part which is used for mounting the second tube lid; the second tube lid is square and the second tube lid is mounted in the second step square hole. Setting the second step square hole is convenient to mount the second tube lid and improve sealing performance of the inner of the first square tube part and second square tube part.

DETAILED DESCRIPTION OF THE INVENTION

The present invention will further be described detailedly as follows by combining the figures with the embodiments.

Figure 1:
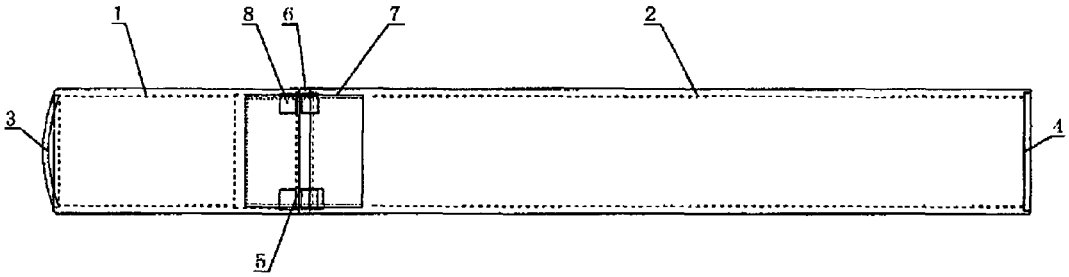
FIG. 1 is a structure diagram of the square cigar tube.
Figure 2:
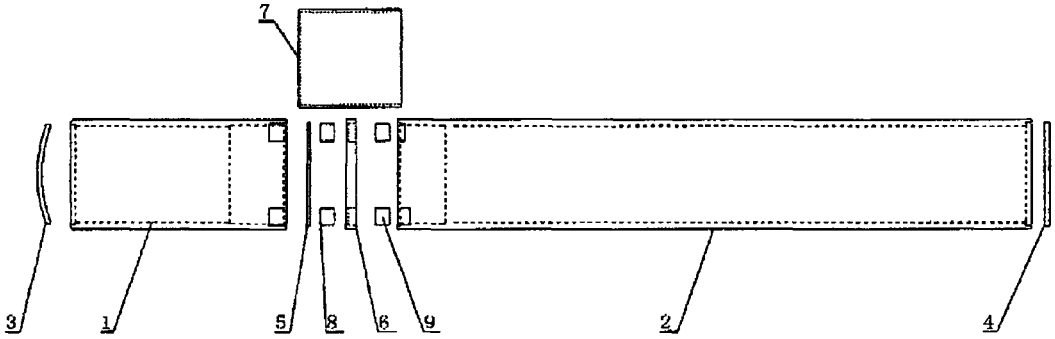
FIG. 2 is an exploded view of the square cigar tube.

The square cigar tube as shown in FIG. 1 and FIG. 2, includes a first square tube part 1, a second square tube part 2, a first tube lid 3, a second tube lid 4, a third tube lid 5, a fourth tube lid 6 and a cigar aluminum tube 7.

Figure 3:
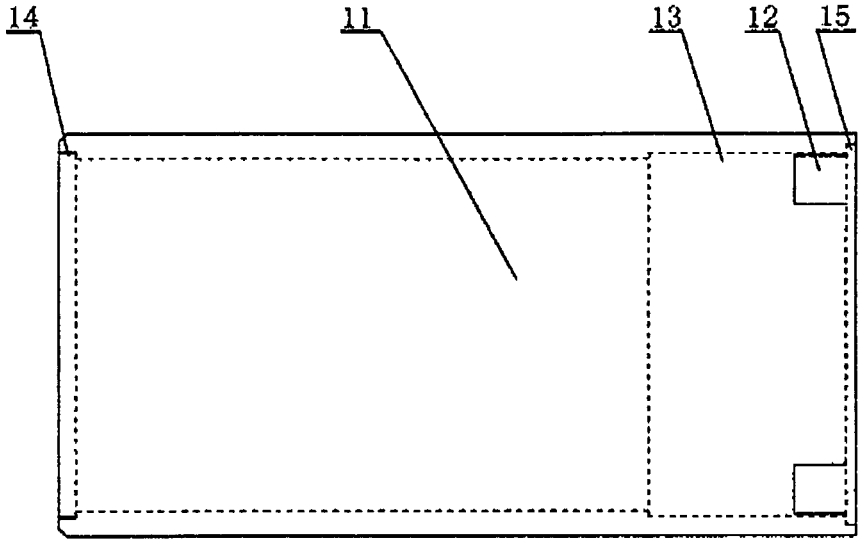
FIG. 3 is a front view of the first square tube part.
Figure 4:
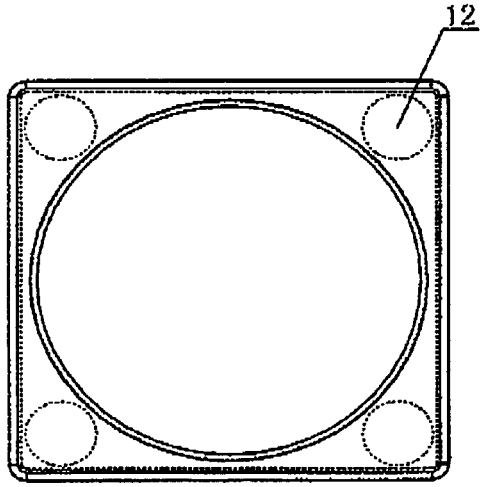
FIG. 4 is a right view of the first square tube part.

As shown in FIG. 3 and FIG. 4, the first square tube part 1 is square, which has a through hole 11 formed therein. The right-hand end of the first square tube part 1 has four first magnet accommodating spaces 12, and as shown in FIG. 1 and FIG. 2, the first magnet accommodating space 12 is used for placing a first magnet 8. The first square tube part 1 has a first step round hole 13 formed at the right-hand end of the through hole 11 thereof, and the first step round hole 13 has a diameter bigger than that of the through hole 11. The left-hand end of the first square tube part 1 has a third step round hole 14 formed thereon; and the right-hand end of the first square tube part 1 has a first step square hole 15 formed thereon.

Figure 5:
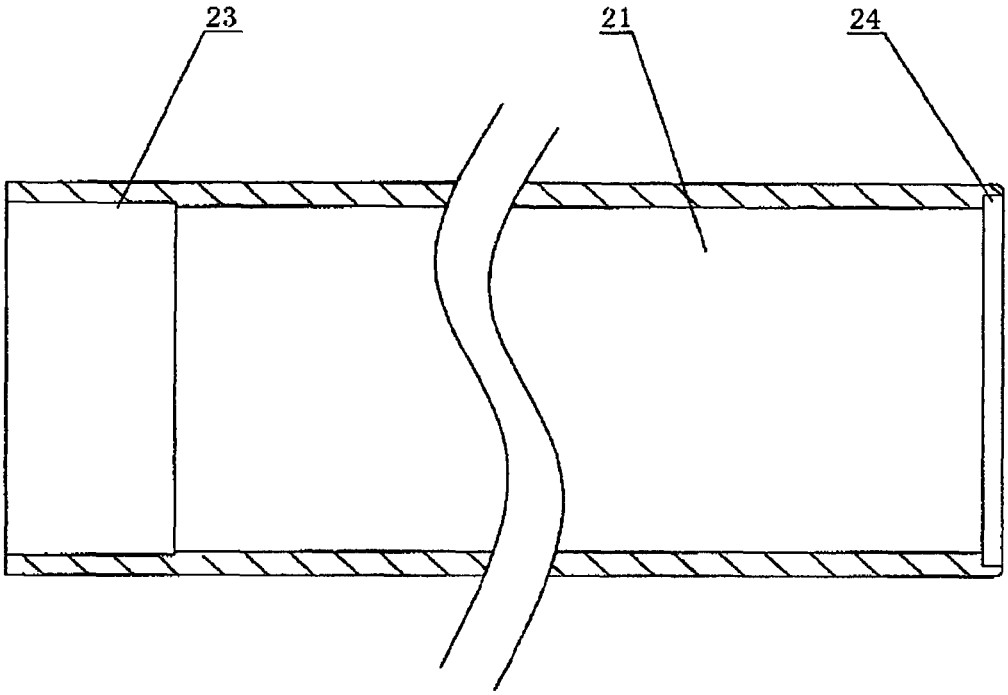
FIG. 5 is a section view of the second square tube part.
Figure 6:
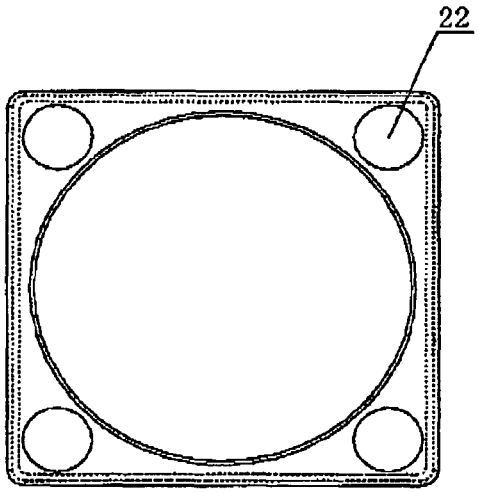
FIG. 6 is a left view of the second square tube part.

As shown in FIG. 5 and FIG. 6, the second square tube part 2 is square, which has a through hole 21 formed therein. The right-hand end of the second square tube part 2 has four second magnet accommodating spaces 22, and as shown in FIG. 1 and FIG. 2, the second magnet accommodating space 22 is used for placing a second magnet 9. The second square tube part 2 has a second step round hole 23 formed at the right-hand end of the through hole 21 thereof, and the second step round hole 23 has a diameter bigger than that of the through hole 21. The right-hand end of the second square tube part 2 has a second step square hole 24 formed thereon.

Figure 7:
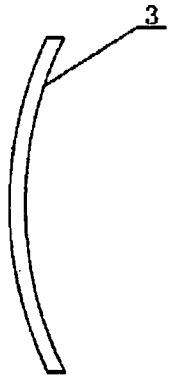
FIG. 7 is a front view of the first tube lid.
Figure 8:
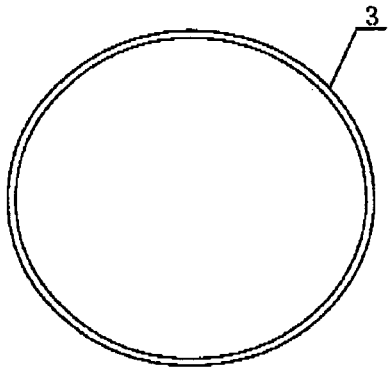
FIG. 8 is a left view of the first tube lid.
Figure 9:
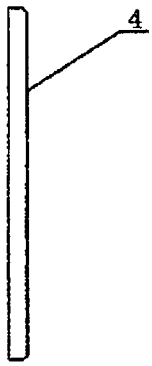
FIG. 9 is a front view of the second tube lid.
Figure 10:
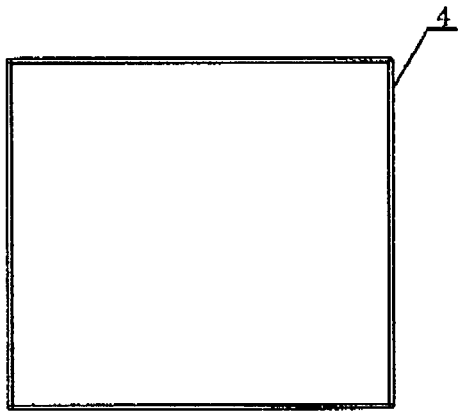
FIG. 10 is a right view of the second tube lid.
Figure 11:
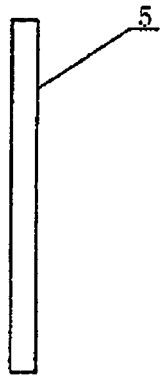
FIG. 11 is a front view of the third tube lid.
Figure 12:
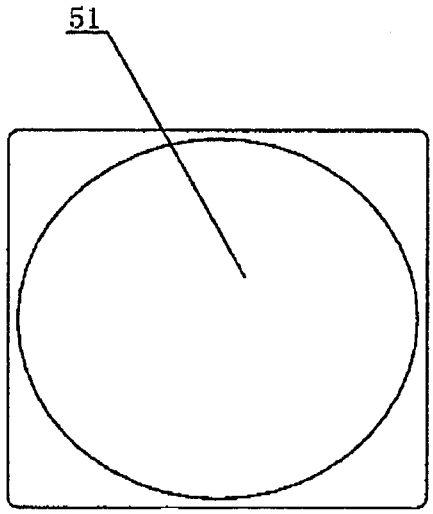
FIG. 12 is a left view of the third tube lid.
Figure 13:
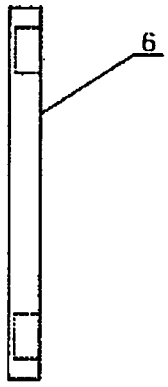
FIG. 13 is a front view of the fourth tube lid.
Figure 14:
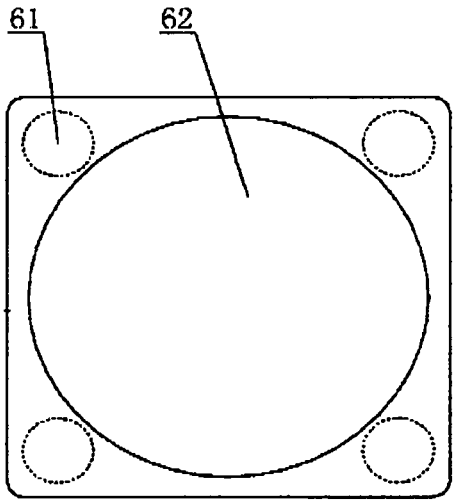
FIG. 14 is a right view of the fourth tube lid.

As shown in FIG. 7 and FIG. 8, the first tube lid 3 is round cambered, and the first tube lid 3 is mounted into the third step round hole 14 by glue. As shown in FIG. 9 and FIG. 10, the second tube lid 4 is square, and the second tube lid 4 is mounted into the second step square hole 24 by glue. As shown in FIG. 11 and FIG. 12, the third tube lid 5 is square and has a through hole 51 formed therein for placing the cigar aluminum tube 7, and the third tube lid 5 is mounted into the first step square hole 15. As shown in FIG. 13 and FIG. 14, the fourth tube lid 6 is square and its cross-section has the same size as that of the second square tube part 2, the cross-section of the first square tube part 1 has the same size as that of the cross-section of the second square tube part 2. The right-hand end of the fourth tube lid 6 has a third magnet accommodating space 61 formed at a location corresponding to that of the second magnet accommodating space 22. One end of the second magnet 9 is mounted into the third magnet accommodating space 61 and the other end is mounted into the second magnet accommodating space 22. The fourth tube lid 6 has a through hole 62 formed therein for placing the cigar aluminum tube 7, and the fourth tube lid 6 is mounted between the first square tube part 1 and the second square tube part 2.

As shown in FIG. 1 and FIG. 2, the left-hand end of the cigar aluminum tube 7 goes through the third tube lid 5 and inserts into the first step round hole 13, and its right-hand end goes though the fourth tube lid 6 and inserts into the second step round hole 23, thus, the first and second square tube parts have good sealing performance. A clearance is arranged between the right-hand surface of the cigar aluminum tube 7 and the step surface of the second step round hole 23, and a cedar or a fragrance fir are arranged in the clearance to keep best taste and original humidity of a cigar.

Owing to setting the first magnet 8 in an end of the first square tube part 1, setting the second magnet 9 in an end of the second square tube part 2, connection between the first square tube part 1 and second square tube part 2 can be realized by attracting between the first magnet and second magnet thereby easy to take out or put in a cigar. Because the cross-section contour of the first square tube part 1 and that of the second square tube part 2 are both designed to be square, it is accurate in positioning and has good hand feeling. Because the first tube lid 3 and the second tube lid 4 can be disassembled and a through hole is produced inside the first square tube part and second square tube part after disassembling, it is convenient to clean.

In this present invention, the left-hand end of the first square tube part is indicated to the end far away from the second square tube part; the right-hand end of the first square tube part is indicated to the end connecting to the second square tube part. The left-hand end of the second square tube part is indicated to the end connecting to the first square tube part; the right-hand end of the second square tube part is indicated to the end far away from the first square tube part.

What is claimed is:

1. A square cigar tube, comprising a first square tube part and a second square tube part, wherein the first square tube part and the second square tube part are connected; a through hole is arranged in the first square tube part, and a through hole is arranged in the second square tube part; a first magnet accommodating space is arranged on an end surface of the first square tube part connected to the second square tube part, and a first tube lid is arranged on the other end; a second magnet accommodating space is arranged on an end surface of the second square tube part connected to the first square tube part, and a second tube lid is arranged on the other end; a first magnet is arranged in the first accommodating space, and a second magnet is arranged in the second accommodating space.

2. The square cigar tube according to claim 1, wherein a first step round hole whose diameter is bigger than that of the through hole of the first square tube part is arranged in the through hole of the first square tube part at the end close to the second square tube part; a second step round hole whose diameter is bigger than that of the through hole of the second square tube part is arranged in the through hole of the second square tube part at the end close to the first square tube part; a cigar aluminum tube is arranged both in the first step round hole and the second step round hole; a clearance is arranged between a step of the second step round hole and an end face of the cigar aluminum tube which is located in the second step round hole; a cedar or a fragrance fir is arranged in the clearance.

3. The square cigar tube according to claim 2, wherein a first step square hole whose side length is bigger than the diameter of the first step round hole is arranged in the first step round hole of the first square tube part at the end close to the second square tube part, a third tube lid is arranged in the first step square hole, and a through hole is formed on the third tube lid.

4. The square cigar tube according to claim 1, wherein a fourth tube lid is arranged between the first square tube part and the second square tube part, the fourth tube lid is square and has a same section size as that of the second square tube part; a third magnet accommodating space is arranged on an end face of the fourth tube lid and the third magnet accommodating space is used for placing the second magnet.

5. The square cigar tube according to claim 1, wherein the first tube lid is cambered; a third step round hole is arranged on an end of the first square tube part for mounting the first tube lid, the first tube lid is arranged in the third step round hole.

6. The square cigar tube according to claim 1, wherein a second step square hole is arranged on an end of the second square tube part which is used for mounting the second tube lid; the second tube lid is square and the second tube lid is mounted in the second step square hole.

* * * * *